US009068325B2

(12) United States Patent
Neagoe

(10) Patent No.: US 9,068,325 B2
(45) Date of Patent: Jun. 30, 2015

(54) ADAPTER FOR ATTACHMENT TO WATER SUPPLY PIPES AND EXTERIOR CONDUITS

(75) Inventor: Alexandru Neagoe, Hockessin, DE (US)

(73) Assignee: SPEAKMAN COMPANY, New Castle, DE (US)

( * ) Notice: Subject to any disclaimer, the term of this patent is extended or adjusted under 35 U.S.C. 154(b) by 723 days.

(21) Appl. No.: 13/426,063

(22) Filed: Mar. 21, 2012

(65) Prior Publication Data

US 2013/0248017 A1 Sep. 26, 2013

(51) Int. Cl.

| | |
|---|---|
| ***A47K 3/20*** | (2006.01) |
| ***E03C 1/04*** | (2006.01) |
| *E03C 1/06* | (2006.01) |

(52) U.S. Cl.

CPC ..... *E03C 1/0408* (2013.01); *Y10T 137/6977* (2015.04); *E03C 1/06* (2013.01)

(58) Field of Classification Search

CPC ..... E03C 1/06; E03C 1/066
USPC ..... 4/567, 568, 570, 601, 695; 137/359, 137/360; 239/443
See application file for complete search history.

(56) References Cited

U.S. PATENT DOCUMENTS

| | | | | |
|---|---|---|---|---|
| 1,054,922 | A | 3/1913 | Kenney | |
| 3,564,621 | A | 2/1971 | Fletcher | |
| 3,724,760 | A | 4/1973 | Smith | |
| 3,982,285 | A | 9/1976 | Roberts, Jr. | |
| 4,274,400 | A | 6/1981 | Baus | |
| 4,282,612 | A | 8/1981 | King | |
| 4,719,654 | A * | 1/1988 | Blessing | 4/597 |
| 5,065,942 | A | 11/1991 | Shannon | |
| 5,749,552 | A | 5/1998 | Fan | |
| 5,878,949 | A | 3/1999 | Matsui et al. | |
| 6,230,989 | B1 | 5/2001 | Haverstraw et al. | |
| 6,438,767 | B1 | 8/2002 | Warshawsky | |
| 6,611,971 | B1 * | 9/2003 | Antoniello et al. | 4/570 |
| 7,043,776 | B1 * | 5/2006 | Wu | 4/601 |
| 7,198,059 | B2 | 4/2007 | Kempf et al. | |
| 7,748,649 | B2 | 7/2010 | Fujii et al. | |
| 8,505,567 | B1 * | 8/2013 | Wu | 137/119.03 |
| 2005/0127211 | A1 | 6/2005 | Yeiser | |
| 2006/0150314 | A1 | 7/2006 | Flieger et al. | |
| 2010/0024909 | A1 | 2/2010 | Lu et al. | |
| 2010/0037389 | A1 | 2/2010 | Gross | |
| 2010/0276020 | A1 | 11/2010 | Fan et al. | |

FOREIGN PATENT DOCUMENTS

| | | |
|---|---|---|
| EP | 2154297 A2 | 2/2010 |

* cited by examiner

*Primary Examiner* — Huyen Le
(74) *Attorney, Agent, or Firm* — Novak Druce Connolly Bove + Quigg LLP

(57) ABSTRACT

An adapter for attachment to a water supply pipe and an exterior conduit includes an adjustable element, a mounting element, and at least one inner fastening element. The adapter also may include filtering elements, covers, and other elements which add in the operation and appearance of the adapter. The adapter may be incorporated in any assembly that requires exterior routing of water from a water supply pipe to one or more exterior conduits. These conduits may be any device or accessory that routes water from the water supply pipe, through the adapter, to an exit point. Examples of exterior conduits include waterborne bars, overhead shower assemblies, handheld shower assemblies, and other types of waterborne accessories.

4 Claims, 6 Drawing Sheets

ADAPTER FOR ATTACHMENT TO WATER SUPPLY PIPES AND EXTERIOR CONDUITS

BACKGROUND

1. Field

The present disclosure relates to sanitary showers and the water conduits which supply water to the showers. Those conduits are typically connected at one end to a stationary showerhead and/or one or more hand held showerheads. This disclosure relates to adjustable adapters for fluidly interconnecting these conduits to a water supply in a manner that accommodates varying thickness of the shower enclosure wall.

2. Description of Related Art

Although shower bars are known to have several benefits, particularly with regard to safety, it is often difficult to install them without significantly altering surrounding wall structures. Conventional shower bars are attached to walls and installed alongside hand-held showers. As such, in addition to the alteration of surrounding wall structures, water sources for hand-held showers must also be routed. Unfortunately, most of the routing requires demolition as well as re-routing of plumbing fixtures located behind walls.

There are numerous existing arrangements of showerheads and means for supplying water to them. But it is often difficult to install them without significantly altering the walls of the shower enclosure, especially when those walls comprise ceramic tile applied over a cementatious base. Varying thicknesses of shower enclosure walls also presents installation problems. An additional installation problem is providing a strong connection of showerhead piping to the enclosure, especially in a hospitality setting. In such settings, a shower bar is often used to facilitate placement of a showerhead at varying heights relative to the bather.

Examples of shower bars, showerheads and means used to attach them to a shower enclosure include the following: U.S. Pat. No. 3,982,285 issued Sep. 28, 1976 (describing a shower bar with a slidably mounted showerhead thereon which is fluidly and fixedly connected to a water supply pipe without means for adjustment to accommodate thickness of shower enclosure walls); U.S. Pat. No. 5,749,552 issued May 12, 1998 (disclosing a shower bar whose upper portion is physically, but not hydraulically, connected to the enclosure wall of the shower; U.S. Pat. No. 6,438,767 (describing a shower bar hydraulically connected to a water supply without an adjustable to accommodate differing wall thickness); and U.S. Patent Application Publication No. 2010/037389 A1 published Feb. 18, 2010 (describing a non-adjustable connection of water supply to shower bar through a wall mounted temperature control fitting).

SUMMARY OF THE DISCLOSURE

The present invention is directed to an adapter for attachment to a water supply pipe and one or more exterior conduits connected to showerheads and/or temperature controls for water supplied to the showerheads. The adapter includes an adjustable element, a mounting element, which secures to a wall-type structure, and at least one inner fastening element that secures to a plumbing waterway. The adapter may also include additional elements such as filtering elements, and covers which aid in the operation and appearance of the adapter.

The adapter may be incorporated in any assembly that requires exterior routing of water from a water supply pipe to one or more conduits within the shower enclosure. Examples of such conduits include waterborne bars, overhead shower assemblies, handheld shower assemblies, and other types of waterborne accessories.

A more complete understanding of the adapter and its incorporation with various types of assemblies will be afforded to those skilled in the art, as well as a realization of additional advantages and objects thereof, by consideration of the following detailed description. Reference will be made to the appended sheets of drawings which will first be described briefly.

DETAILED DESCRIPTION

Figure 1:
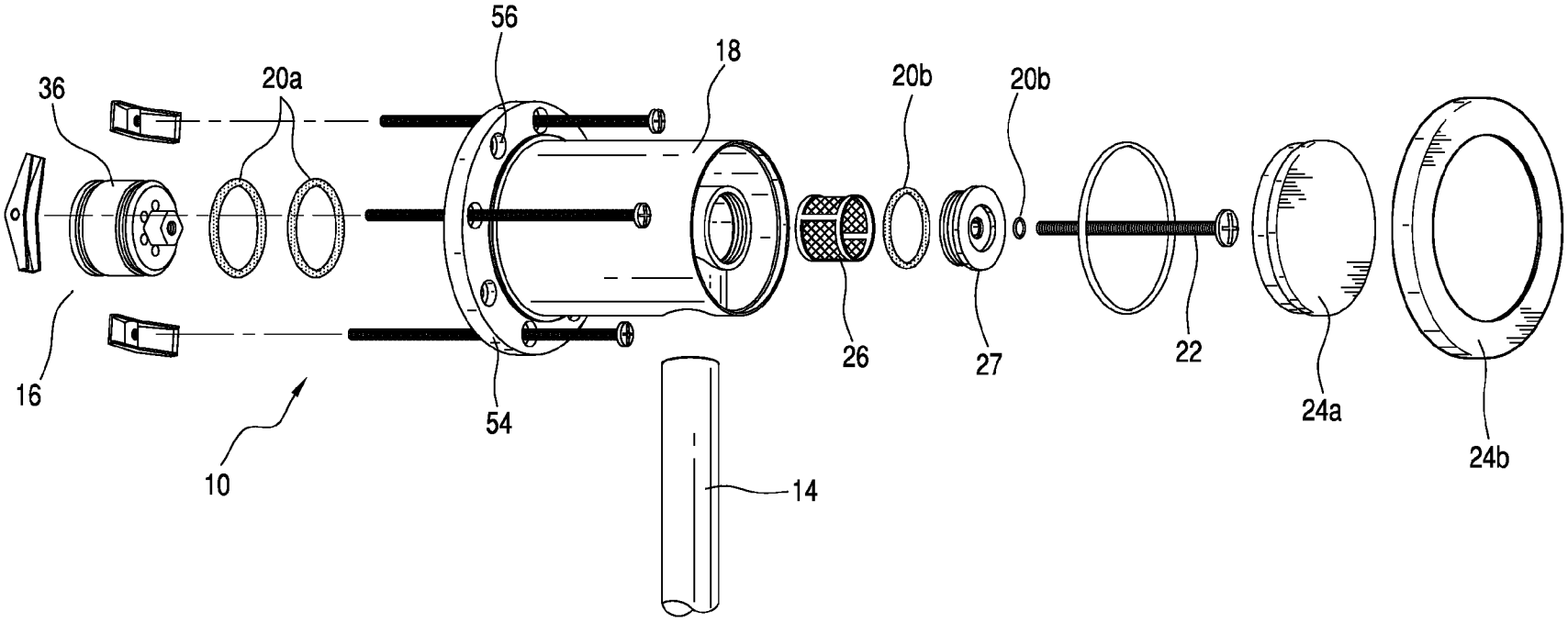
FIG. 1 is an exploded view of an adapter coupled to a waterborne bar.
Figure 2:
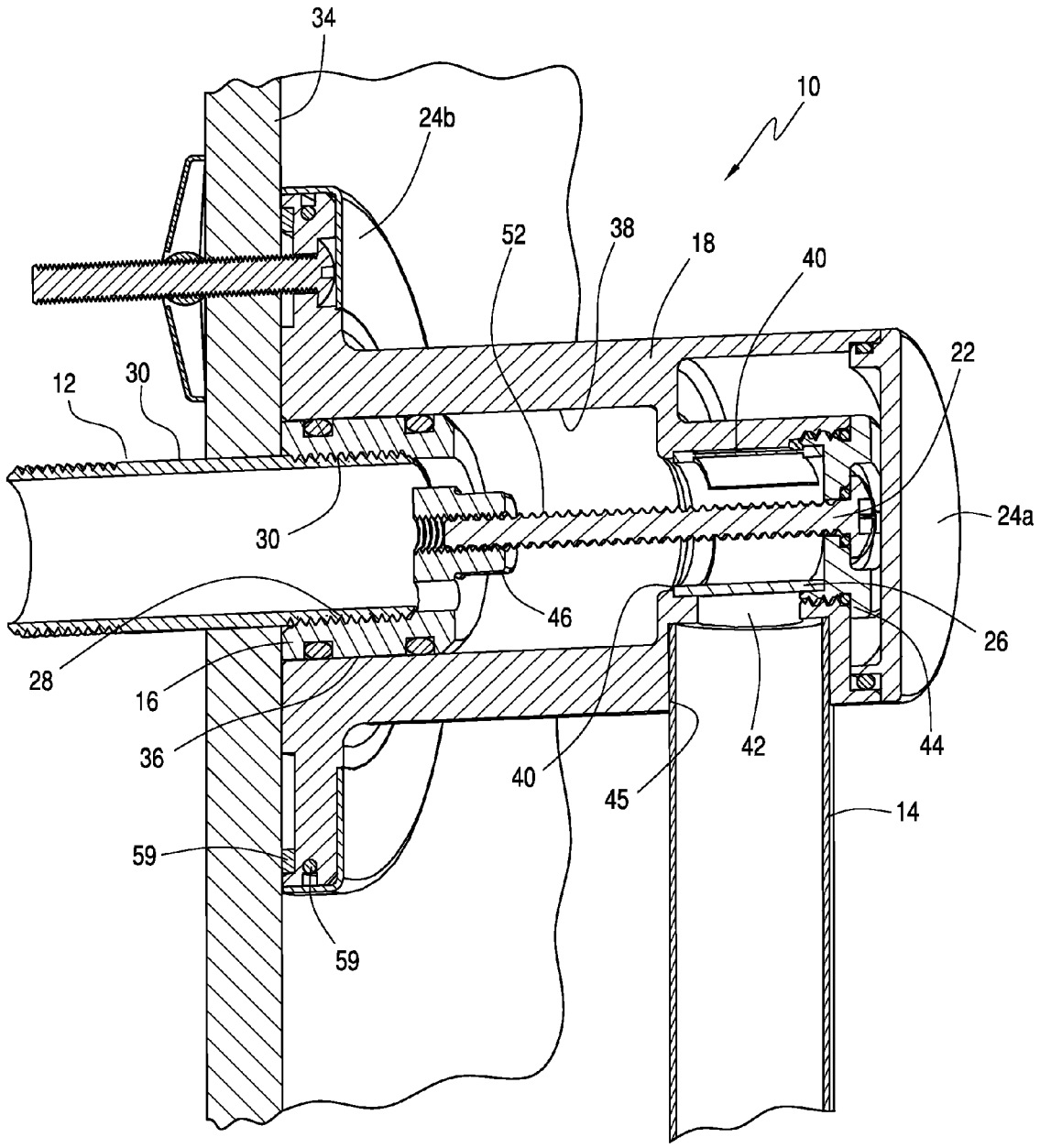
FIG. 2 is a side cross-sectional view of an assembled adapter coupled to a waterborne bar.
Figure 3:
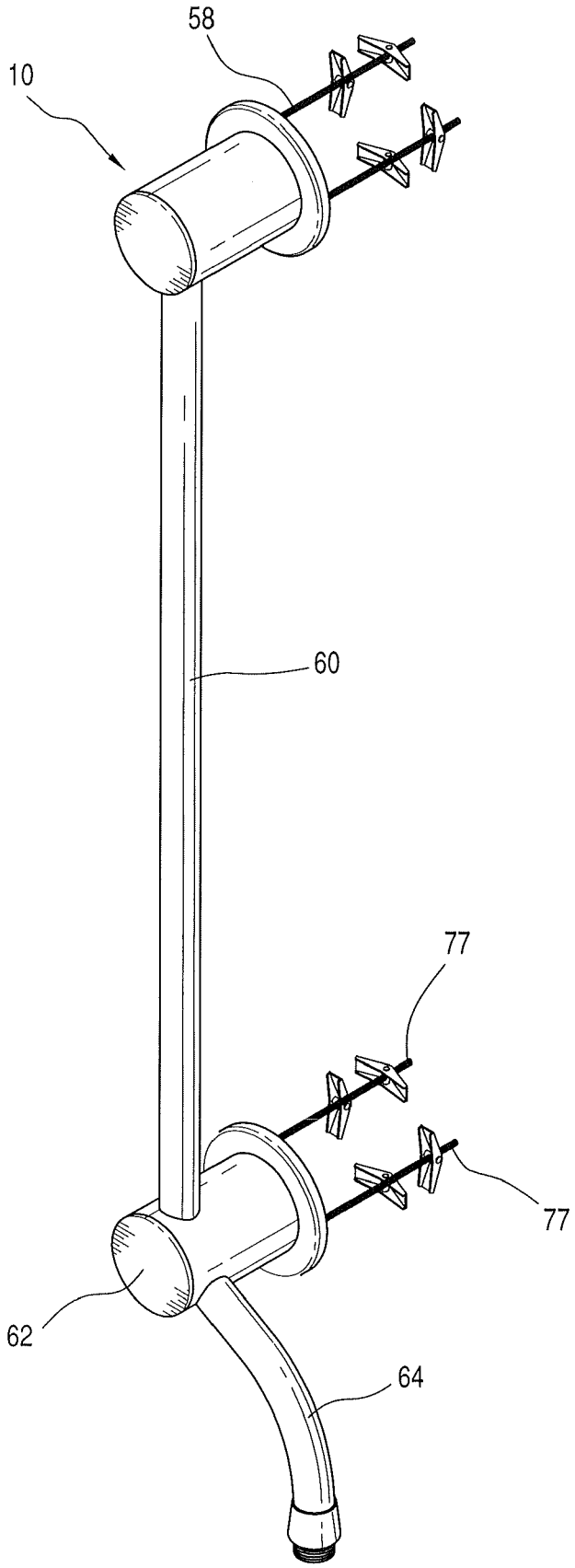
FIG. 3 is a perspective view of a shower assembly incorporating an adapter, a waterborne bar, and a mounting unit.
Figure 4:
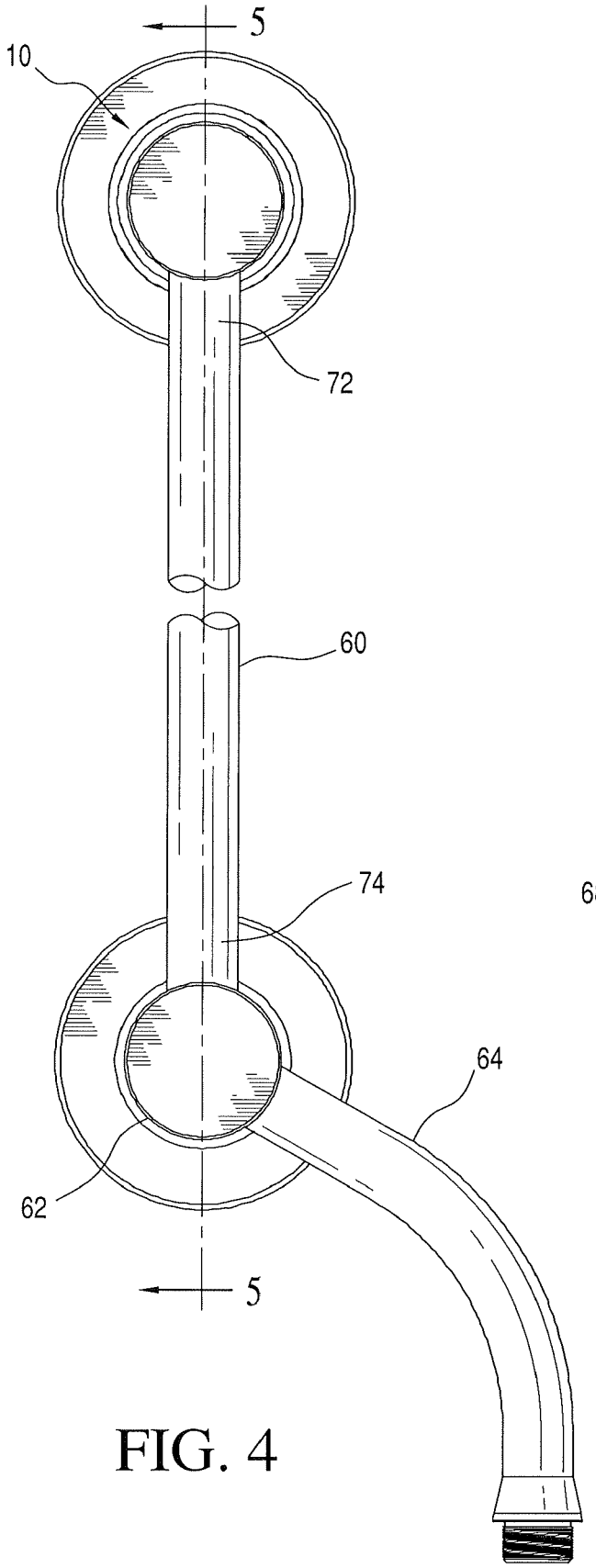
FIG. 4 is front broken view of the shower assembly shown in FIG. 3.

FIGS. 1 and 2 respectively show exploded and cross-sectional views of an adapter 10 configured for attachment to a water supply pipe 12 (FIG. 2) and an exterior conduit 14. The adapter 10 includes an adjustable element 16 that couples with the water supply pipe 12 and a mounting element 18 disposed over the adjustable element 16 that couples with the exterior conduit 14. The adapter 10 also includes sealing elements 20*a*, 20*b*, an inner fastening element 22, a cover 24, filtering element(s) 26, and an optional positioning device 27, as further described below.

As used herein, an exterior conduit is defined as any conduit for water or other fluids, which are positioned on the exterior (bather's side) of a wall-type structure such as a shower enclosure. The wall-type structure is to be broadly construed as any structure having water supply piping positioned behind the structure. Thus, the external conduit is not necessarily limited to positioning external to bathroom-type plumbing fixtures located behind a wall.

Figure 5:
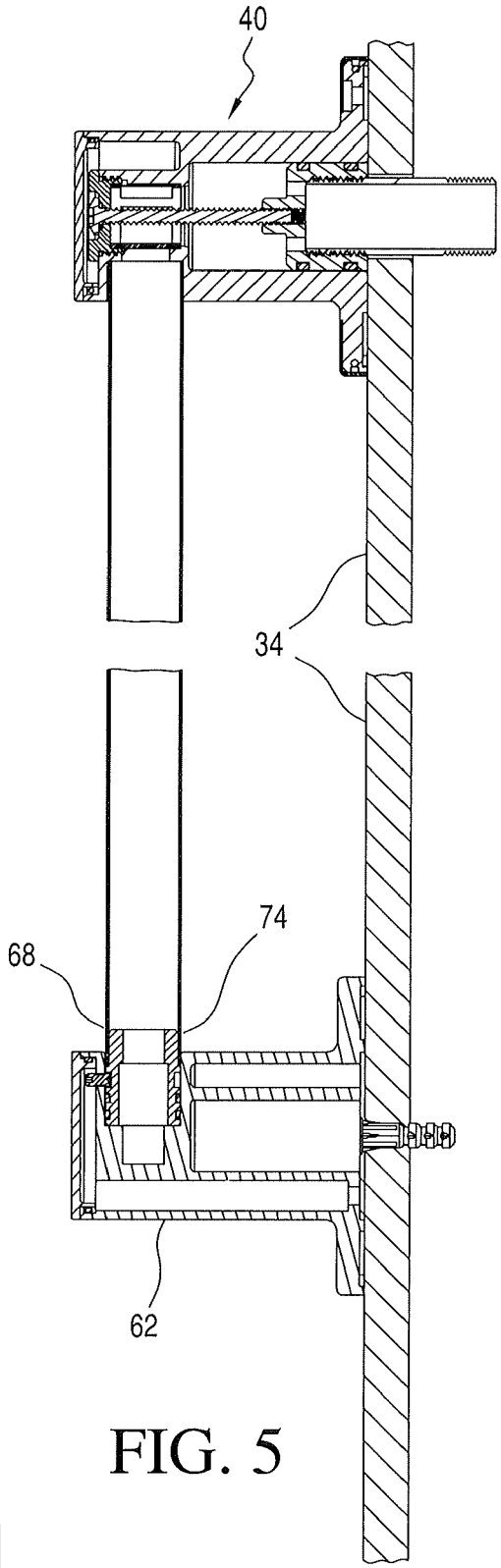
FIG. 5 is a side cross-sectional view of the shower assembly shown in FIG. 4 taken along line 5-5.

The adapter 10 includes an adjustable element 16 configured for attachment to the water supply pipe 12. As such, the adjustable element 16 is provided with an inner bore 28 that is sized to mate with the outer bore 30 diameter of the water supply pipe 12. The adapter 10 is then positioned against a wall-type structure 32 (FIGS. 2 and 5). However, to assure proper positioning against a wall-type structure, an installer may have to make additional adjustments relating to the water-supply pipe.

The adapter is configured to couple with wall-type structures having varying thicknesses. These thicknesses could vary based on the materials used to manufacture the wall structure as well as addition elements (not shown) such as tile and other decorative and/or structural elements. Thus for proper positioning of the adapter, an installer may be required to size the wall-supply pipe to extend a predetermined distance away from the wall-type structure. For example, an installer may size a water supply pipe to extend from about 1 to about 2 inches away from the wall-type structure.

In the configuration shown, the mating elements 30 are threads disposed respectively on the outer and inner surfaces of the water supply pipe 12 and adjustable element 16. Although threads are shown, other types of mating elements may be used. For example, the water supply pipe and the adjustable element may be coupled using snap rings, set screws, and lock and key arrangements.

The adjustable element 16 is also configured for adjustable positioning within mounting element 18. As such, the outermost surface(s) 36 of the adjustable element is slightly smaller than an adjustment bore 38 of the mounting element 18. The size and shape of the outermost surface(s) 36 thus allows for linear positioning of the adjustable element within the adjustment bore 38. As a result, the adapter can compensate for water supply pipes that extend from wall-type structures various distances.

In addition to the adjustment bore 38, included with the mounting element 18, are a filtering bore 40, an outlet port 42, a mating section 44, and a conduit cavity 45. The filtering bore 40 is configured to mate with a filtering element 26 that couples with the filtering bore 40. As such, the filtering element 26 is configured to filter water before it travels through the outlet port 42 and to the exterior conduit 14. This filtering is particularly useful when the adapter 10 is coupled to water supply pipes located in older buildings. In many cases, after years of use, debris will build up in older piping systems. Use of the filtering element thus allows for removal of debris and other types of deposits during periodic maintenance.

To couple the mounting element 18 with the adjustable element 16, one or more inner fastening elements 22 may be disposed through the mating section 44 and a connecting section 46 on the adjustable element. The fastening element 22 may be configured as a screw having sufficient length to provide for relative positioning of the adjustable element 16 within the adjustment bore 38. As such, the connecting section 46 of the adjustable element is provided with an inner bore 48 having threads 50 that mate with screw threads 52. Use of fastening elements is also particularly useful in situations where a water supply pipe is not secured properly in a wall-type structure.

The mounting element 18 is also provided with a conduit cavity 45 used to position and couple the exterior conduit 14. This cavity is sized such that the exterior conduit and the mounting element may be brazed together. Brazing allows for a substantially secure fit and leakage prevention, during use of the adapter. In addition to brazing other methods of coupling the mounting element and the exterior conduit may be used. Suitable methods include soldering, threading, and use of adhesives.

To facilitate positioning of the adapter 10 against the wall-type structure 32, the mounting element 18 also includes a flange portion 54. The flange portion 54 is provided with a plurality of holes 56 positioned circumferentially around the flange. The holes are sized to mate with fasteners 58 that allow the adapter 10 to mount to the wall-type structure 32. These fasteners are preferably commercially available toggle screws. For leakage prevention, gaskets 59 may be provided adjacent to the flange portion 54.

Also disposed within the adapter 10 are sealing elements 20*a*, 20*b*. As particularly shown in FIG. 1, a first set of sealing elements 20*a* are positioned between the adjustable element 16 and the adjustment bore 38 and a second set of sealing elements 20*b* are positioned within the mating section 44. Preferably these sealing elements 20*a*, 20*b* are disposed in cavities disposed on the surfaces of the adjustable element and the mating section 44. These sealing elements are, therefore, positioned and designed to substantially prevent leakage as water travels from the water supply pipe to the exterior conduit 14. The sealing elements may be standard o-rings or other types of seals and/or sealing devices which substantially prevent leakage.

For aesthetic purposes, the adapter 10 may also include a cover 24, having two primary sections 24*a*, 24*b*. A first cover section 24*a* is positioned over an outer opening of the mounting element 18, while a second cover section 24*b* is positioned over the flange portion. In providing these cover sections, fastening elements are hidden from view such that the adapter has a seamless appearance that is aesthetically pleasing to users.

Each component of the adapter is preferably manufactured from one or more materials with relatively stable thermal properties. These materials should be able to withstand fluid temperatures ranging from about 40° F. to about 150° F. without significant thermal deformation. Suitable materials include, but are not limited to, corrosion resistant steels, copper, thermoplastic materials, and brass.

During assembly of the adapter 10, the adjustable element 16 is coupled to the water supply pipe 12 with sealing elements 20*a* in position. With the filtering element 26 and sealing elements 20*b* respectively predisposed within the filtering bore 40 and the mating section 44, the mounting element 18 is then positioned over the adjustable element 16. Using fastening element 22, the mounting element is attached to the adjustable element. In one configuration, the fastening element 22 is screwed into the adjustable element 16 and coupled to the water supply pipe, using connection section 46. Fasteners 58 are then used to attach the mounting element 18 to the wall-type structure 32. The cover 24 may then be positioned over outer opening and flange portion.

The adapter may be incorporated into any assembly that requires routing of water from a water supply pipe to one or more exterior conduits such as a waterborne bar, an overhead shower bar, or any other type of waterborne accessory, requiring exterior routing from a water supply pipe to an exterior conduit. As used herein the term "waterborne" is used to indicate devices used to transport water from an initial location within the adapter to an exit location.

The adapter 10 may be incorporated into various types of assemblies. Each of the assemblies shown in FIGS. 3-8 includes an exterior conduit configured as a waterborne bar 60. The waterborne bar 60 may be designed to have sufficient strength and material properties for use as a grab bar and/or a slide bar. As such, the bar is appropriate for repeat use and stresses applied by users during positioning of other waterborne accessories and for maintaining stability of a user during use.

Figure 6:
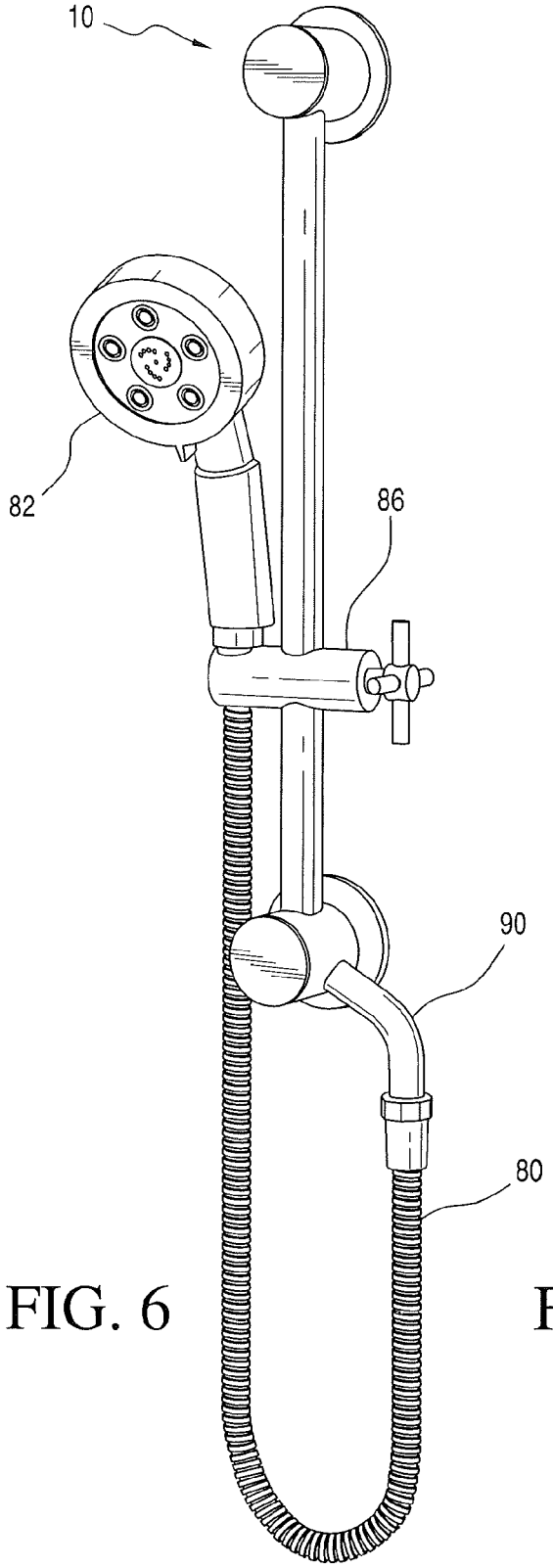
FIG. 6 is a perspective view of a shower assembly, incorporating an adapter, a waterborne slide bar, mounting unit, handheld showerhead, and handheld mount.
Figure 7:
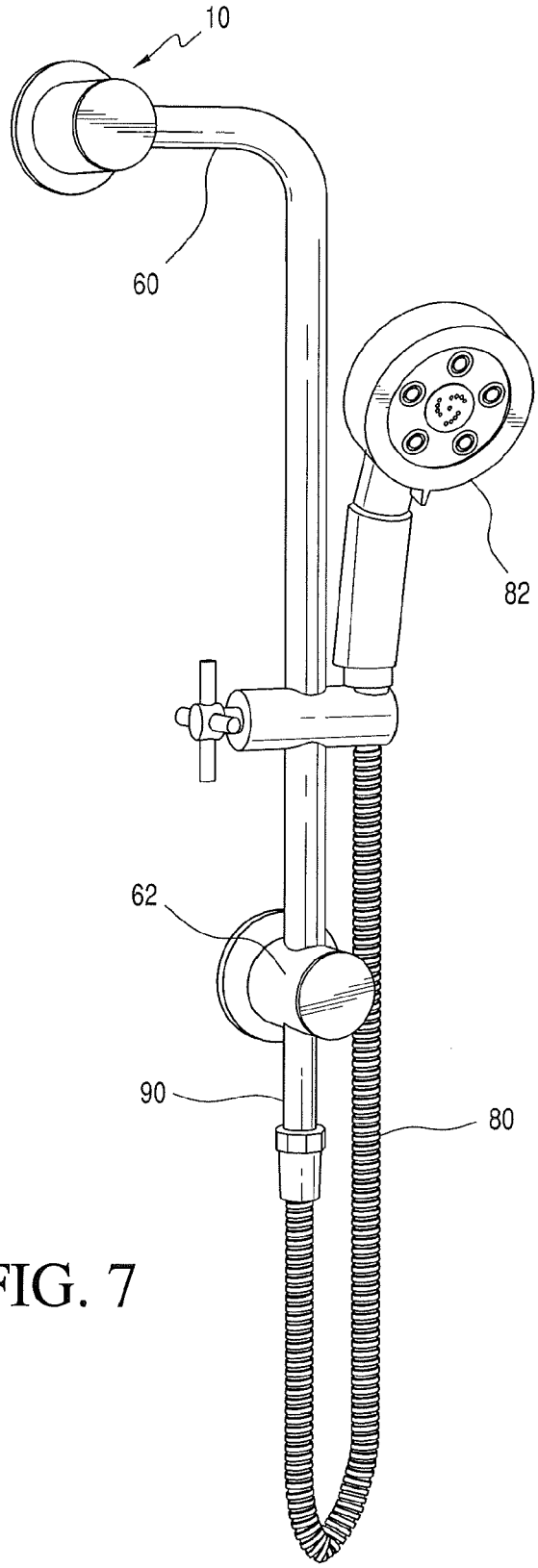
FIG. 7 is a perspective view of a second type of shower assembly, incorporating an adapter, a waterborne slide bar, mounting unit, handheld showerhead, and showerhead mount.
Figure 8:
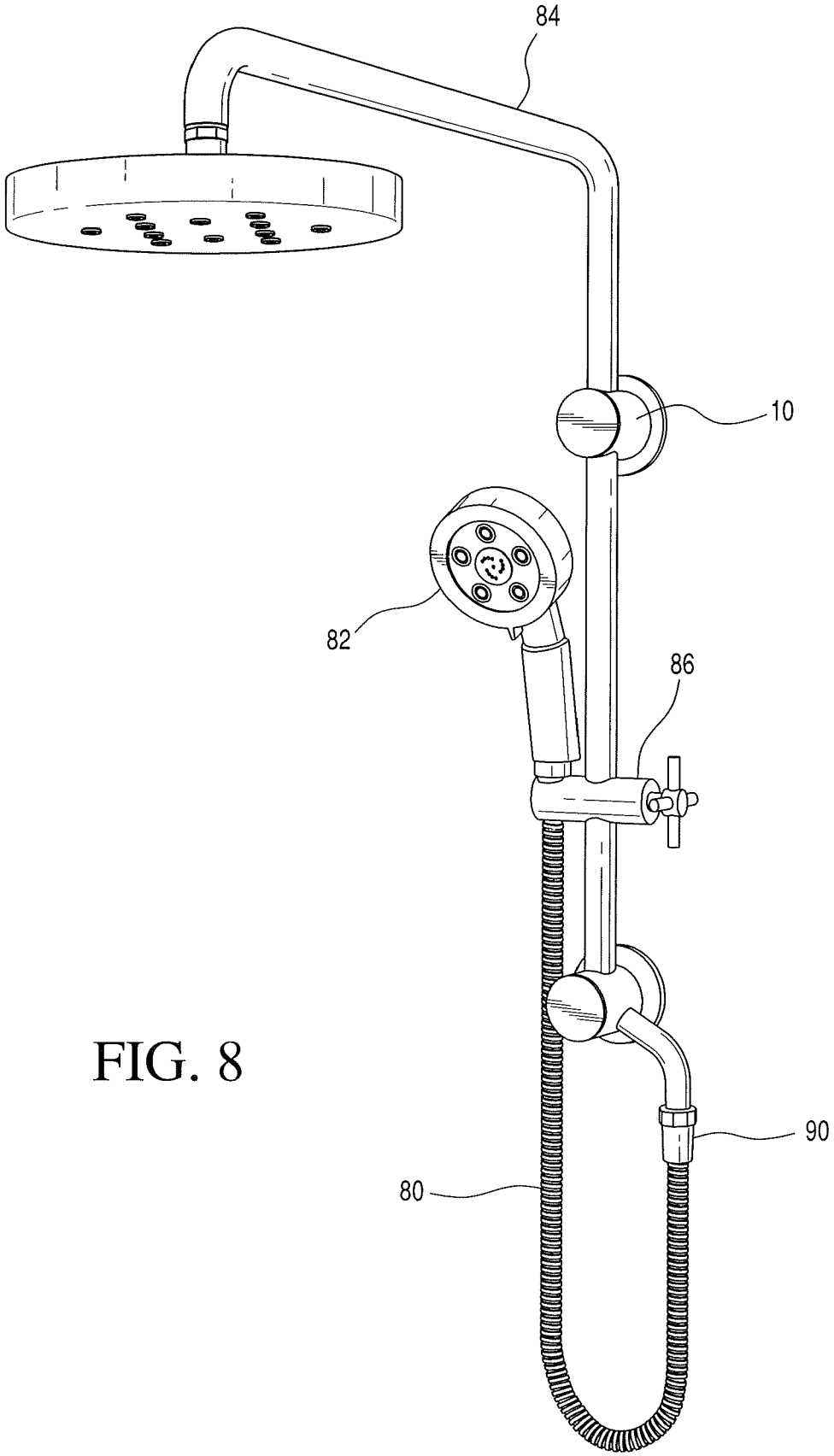
FIG. 8 is a perspective view of a third type of shower assembly, incorporating an adapter, a waterborne slide bar, mounting unit, handheld showerhead, handheld mount, and overhead shower assembly.

Each type of assembly shown in FIGS. 3-8 may also include a mounting unit 62, and one or more conduits 64 coupled to the mounting unit 62. Water flow indicated by arrows 66 is routed from the waterborne bar 60 to travel through the mounting unit 62 to the conduit 70, as particularly shown in FIG. 5. The conduit element(s) may then be coupled to one or more additional waterborne accessories (FIGS. 6-8).

The waterborne bar 60 includes an upper portion 72 that couples with the adapter 10 and a lower portion 74 that couples with the mounting unit 62. As such, the outer diameter of the bar is suitable for placement within mounting unit

62. To allow for positioning of the waterborne bar 60 with the mounting unit 62, a pivoting element 68 may be provided. The pivoting element 68 provides for disassembly of the mounting unit 62 and access to a handheld mount 86. The flexibility provided by the pivoting element 68 further provides for maintenance and replacement of the handheld mount 86.

The mounting unit 62 preferably has an outer appearance which is visually similar to that of the adapter 10. The mounting unit 62 comprises a mounting cavity 75 that couples with the waterborne bar 60 and a passageway 76 that couples with a waterborne accessory 80, shown here as a tubular element. Coupled to the mounting unit 62 are fasteners 77 which allow for substantially flush mounting of the back portion 78 of the mounting unit.

Additional waterborne accessories such as handheld showerheads 82 and overhead shower assemblies 84 may also be coupled to the mounting unit 62. One or more valves 90 may also be disposed between the mounting unit 62 and waterborne accessories 80, 82, 84 for control of water flow. In addition, where a handheld showerhead is a waterborne accessory, a handheld mount 86 may be added to the bar for linear positioning of the showerhead 82.

While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. An adapter 10 for fluidly connecting a water supply pipe 12 extending through a wall to at least one water bearing outlet port 42 comprising, a generally cylindrical adjustable element 16 for attachment to the water supply pipe 12 having flexible seals about its periphery and a central attachment means 46, a generally cylindrical mounting element 18 linearly movable relative to, and in water tight engagement with, the seals surrounding the adjustable element 16, having a flange 54 at one end for secure fastening to a wall through which the water supply pipe is routed and an outlet port 42 at an opposite end in fluid communication with the water supply pipe 12, wherein the mounting element 18 has attachment means 22 for secure, but adjustable, attachment of the mounting element to the adjustable element 16.

2. The adapter of claim 1, further comprising one or more waterborne accessories coupled to the outlet port.

3. The adapter of claim 1, further comprising a handheld showerhead coupled to the outlet port.

4. The adapter of claim 1, wherein a waterborne bar is coupled to the outlet port.

* * * * *